US007407267B2

(12) United States Patent
Enomoto et al.

(10) Patent No.: US 7,407,267 B2
(45) Date of Patent: Aug. 5, 2008

(54) LIQUID DROPLET EJECTION HEAD AND IMAGE FORMING APPARATUS

(75) Inventors: Katsumi Enomoto, Kanagawa (JP); Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 236 days.

(21) Appl. No.: 11/131,192

(22) Filed: May 18, 2005

(65) Prior Publication Data

US 2005/0259127 A1 Nov. 24, 2005

(30) Foreign Application Priority Data

May 19, 2004 (JP) ..... 2004-149133

(51) Int. Cl.
*B41J 2/14* (2006.01)

(52) U.S. Cl. ..... 347/49

(58) Field of Classification Search ..... 347/42, 347/49

See application file for complete search history.

(56) References Cited

U.S. PATENT DOCUMENTS

| | | | | |
|---|---|---|---|---|
| 4,658,272 | A * | 4/1987 | Toganoh et al. | 347/42 |
| 5,257,043 | A | 10/1993 | Kneezel | |
| 5,473,353 | A * | 12/1995 | Soucemarianadin et al. | 347/74 |
| 5,481,284 | A * | 1/1996 | Kitahara et al. | 347/42 |
| 5,565,900 | A * | 10/1996 | Cowger et al. | 347/42 |
| 6,499,823 | B2 * | 12/2002 | Okazaki et al. | 347/20 |
| 2002/0008731 | A1 | 1/2002 | Matsumoto et al. | |
| 2004/0080568 | A1 | 4/2004 | Matsuo et al. | |
| 2004/0085393 | A1 * | 5/2004 | Scheffelin et al. | 347/42 |
| 2005/0206692 | A1 | 9/2005 | Sanpei et al. | |
| 2007/0013738 | A1 * | 1/2007 | Silverbrook | 347/49 |

FOREIGN PATENT DOCUMENTS

| | | | |
|---|---|---|---|
| JP | 3-246038 | A | 11/1991 |
| JP | 5-270099 | A | 10/1993 |
| JP | 6-143602 | A | 5/1994 |
| JP | 10-95114 | A | 4/1998 |
| JP | 10095114 | A * | 4/1998 |
| JP | 11-342634 | A | 12/1999 |
| JP | 2001-96734 | A | 4/2001 |
| JP | 2002-36522 | A | 2/2002 |
| JP | 2002-96462 | A | 4/2002 |
| JP | 2002-205389 | A | 7/2002 |
| JP | 2002-225263 | A | 8/2002 |
| JP | 2002-337320 | A | 11/2002 |
| JP | 2003-505281 | A | 2/2003 |
| WO | WO-01/08888 | A1 | 2/2001 |
| WO | WO-2004/022344 | A1 | 3/2004 |

* cited by examiner

*Primary Examiner*—Matthew Luu
*Assistant Examiner*—Justin Seo
(74) *Attorney, Agent, or Firm*—Birch, Stewart, Kolasch & Birch, LLP

(57) ABSTRACT

The liquid droplet ejection head comprises: a base plate which has a common supply flow channel formed throughout an entire dimension in a lengthwise direction of the base plate; a plurality of short head modules which are assembled on the base plate to form a long head, each of the plurality of short head modules including ejection ports ejecting droplets of liquid and a liquid flow channel supplying the liquid to the ejection ports from the common supply flow channel; and a positioning mechanism through which the short head modules are detachably installed on the base plate.

3 Claims, 11 Drawing Sheets

LIQUID DROPLET EJECTION HEAD AND IMAGE FORMING APPARATUS

BACKGROUND OF THE INVENTION

1. Field of the Invention

The present invention relates to a liquid droplet ejection head and an image forming apparatus, and more particularly, to a liquid droplet ejection head and an image forming apparatus in which a long line head is formed by detachably arranging a plurality of short heads in the breadthways direction of a recording medium.

2. Description of the Related Art

A liquid droplet ejection head such as an inkjet head is known in which ink is supplied to nozzles, for example, and a recording is performed by ejecting the ink in the form of minute ink droplets from the nozzles toward a recording medium. Furthermore, an inkjet printer is also known as an image forming apparatus, which forms images on recording media in accordance with print data (image data) by ejecting ink in the form of liquid droplets from a plurality of nozzles (liquid droplet ejection ports) while moving an inkjet head (liquid droplet ejection head) in which the nozzles are arranged, and the recording medium relatively to each other.

There are inkjet printers of a serial head type provided with a short head for scanning the recording medium in the breadthways direction of the recording medium to perform recording, and of a line head type provided with a long line head having a length corresponding to the maximum width of the recording medium and having nozzles arranged so as to correspond to the full dimension of this length.

In a printer using a serial head, recording is performed by recording one line (or a few lines) by scanning the recording medium with the head in the breadthways direction of the recording medium, and conveying the recording medium in a direction perpendicular to the breadthways direction through a distance corresponding to the number of lines recorded by one scan in the breadthways direction, each time one line (or a few lines) is recorded. Therefore, it not only requires a conveyance system, such as a carriage, which carries the short head in the breadthways direction of the recording medium, but also requires complicated scanning control of the movement of the carriage and the recording medium.

On the other hand, in a printer using a line head, it is possible to record an image onto the full surface of the recording medium by simply scanning the recording medium in a direction perpendicular to the direction of arrangement of the nozzles, and therefore it does not require a conveyance system, such as a carriage for carrying a short head, and neither does it require complicated scanning control of the movement of the carriage and the recording medium. Furthermore, since recording can be performed onto the whole surface of the recording medium by moving only the recording medium in a direction perpendicular to the breadthways direction thereof, it is possible to achieve a high recording speed compared to a printer that uses a serial head.

In an inkjet printer, one image is represented by combining dots formed by ink ejected from the nozzles. High image quality can be achieved by achieving high density arrangement of the nozzles provided in the inkjet head, in such a manner that the size of the dots is reduced and the number of pixels per image is increased.

In general, when manufacturing a long line head, it is essential that the nozzles are positioned to a high degree of accuracy. However, as the components becomes longer, production yield decreases due to the increase in the number of nozzles, and there is a tendency for the accumulated pitch error caused by machining to increase. In order to avoid problems of this kind, various methods have been proposed in which a long line head is manufactured by connecting together a plurality of small heads located highly accurately in position.

However, in a conventional long line head achieved by aligning short heads, since each of the short heads is completely independent, there is variation in the ink supply, unless the internal pressure is controlled in each individual short head, and hence stability declines.

For example, Japanese Patent Application Publication No. 2002-225263 discloses a long line head composed by arranging a plurality of pressure chambers in each of pressure chamber rows in an oblique direction with respect to the lengthwise direction of the head, arranging the plurality of pressure chamber rows in mutually parallel with the lengthwise direction of the head, and further arranging actuator blocks, each formed in the shape of a parallelogram having sides parallel to the lengthwise direction of the pressure chamber rows, in the lengthwise direction of the head, in such a manner that the actuator blocks are mutually separated. In this line inkjet head and a recording apparatus using same, advantages are obtained in that uniform characteristics, such as the piezoelectric characteristics and film thickness of the thin film actuators, can be achieved, fracturing of the films can be prevented, the production yield rate can be improved, the manufacturing equipment can be reduced in size, costs can be lowered, and the like. However, only the actuators are separately formed, the flow channel members must be manufactured to a large length, the accumulated pitch error becomes large, and the whole head must be replaced even if there is a fault in only one part of the flow channel.

Japanese Patent Application Publication No. 2002-36522 discloses a line head composed by forming ink flow channels so as to traverse the paper feed direction, arranging head chips alternately on either side of the ink flow channels in such a manner that ink is drawn from the ink flow channels, and connecting the head chips (short heads) together, then high-resolution printing accuracy can be achieved by means of a simple composition. However, the divided head chips are fixed to the base of a common flow channel, and therefore it is not possible to replace heads, and the whole head must be replaced if a portion of the nozzles develops an ejection failure.

Japanese Patent Application Publication No. 2002-337320 discloses a line type inkjet printer composed by alternately arranging short matrix type inkjet heads, which each form independently serviceable and replaceable units, then the total number of alternately arranged short head is counted up, the odd-numbered heads are fixed in position, and the even-numbered heads are allowed an adjustment width of 1 pixel, in such a manner that print width errors, or print irregularities at the joints between heads, can be avoided. The cross-sectional area of the common liquid chambers is increased due to the matrix arrangement, ink of high viscosity can be ejected, and the respective heads can be replaced individually; however, liquid still remains inside the head when a head is replaced and hence maintenance properties are poor.

Japanese Patent Application Publication No. 2001-96734 discloses that a long head having a substantially large number of nozzles is achieved by using a plurality of short heads, then a long head length can be achieved by detachably arranging short heads on a sub carriage, in such a manner that the regions corresponding to the joints between the short heads, where there are no nozzles, are printed by shifting the position of the heads and performing a further scanning action. However, the heads are completely independent and their internal pressures are controlled individually, and furthermore, since there are gaps without nozzles at the joints between heads, then it is not possible to print one image in a single pass. Moreover, similarly to Japanese Patent Application Publication No. 2002-337320, ink remains inside the head when a head is replaced and hence maintenance properties are poor.

Furthermore, it is important that the ink is uniformly supplied to the respective pressure chambers at high speed, when a head is formed to a large length. Japanese Patent Application Publication No. 6-143602 discloses that one end of a pressure chamber is connected to a first reservoir, the other end of the pressure chamber is connected to a second reservoir, and the other end of the first reservoir and the other end of the second reservoir are connected to a third reservoir, ink being supplied to one reservoir and being expelled from another, thereby creating a circulation of the liquid inside the pressure chambers, then uniform, high-speed ink replenishment can be achieved, and wasteful consumption of ink can be suppressed, thus reducing running costs. However, since there are a plurality of supply restrictors in the pressure chambers, pressure loss is reduced and the reflux of ink upon ink ejection becomes large, thus leading to a problem in that a large energy is required in the actuators in order to eject ink.

SUMMARY OF THE INVENTION

The present invention has been contrived in view of the foregoing circumstances, an object thereof being to provide a liquid droplet ejection head and image forming apparatus whereby a long head can be constituted by combining a plurality of short heads in a detachable manner, while enabling high-speed ejection, as well as simplifying the head structure, improving production yield, and improving maintenance properties.

In order to attain the aforementioned object, the present invention is directed to a liquid droplet ejection head, comprising: a base plate which has a common supply flow channel formed throughout an entire dimension in a lengthwise direction of the base plate; a plurality of short head modules which are assembled on the base plate to form a long head, each of the plurality of short head modules including ejection ports ejecting droplets of liquid and a liquid flow channel supplying the liquid to the ejection ports from the common supply flow channel; and a positioning mechanism through which the short head modules are detachably installed on the base plate.

According to the present invention, it is possible to replace the short head in unit of individual short head modules, if a fault develops in a short head module. Therefore, maintenance properties can be improved.

Preferably, the liquid droplet ejection head further comprises connecting sections by which the plurality of short head modules are detachably attached on the base plate so that the plurality of short head modules are positioned so as to partially overlap with each other in the lengthwise direction of the base plate, and the liquid flow channel in each of the plurality of short head modules is directly connected to the common supply flow channel of the base plate. By this means, it is possible to form a long head in which liquid droplet ejection ports (nozzles) are arranged at high density. Furthermore, it is also possible to achieve a structure in which the corrective droplet ejection at the joint sections between the short head modules can be performed readily.

Preferably, the positioning mechanism also serves as a connecting section between the common supply flow channel of the base plate and the liquid flow channel in each of the plurality of short head modules.

Preferably, the liquid droplet ejection head further comprises a check valve provided on the base plate at a connecting section between the common supply flow channel of the base plate and the liquid flow channel in each of the plurality of short head modules.

Preferably, when replacing one of the plurality of short head modules, the one of the plurality of short head modules is removed after the liquid is emptied out of the one of the plurality of short head modules through the check valve.

Preferably, the common supply flow channel of the base plate has a flow path structure without any dead-end sections, in order to circulate the liquid within the base plate.

Preferably, each of the plurality of short head modules is provided with at least two connecting sections between the liquid flow channel in the short head module and the common supply flow channel of the base plate. It is thereby possible to suppress locality in the flow path resistance in the long head, and therefore, a stable liquid droplet supply and stable ejection amount can be ensured.

In order to attain the aforementioned object, the present invention is also directed to an image forming apparatus, comprising the above-described liquid droplet ejection head. Preferably, a drive waveform which corrects an ejection amount of each of the plurality of short head modules is applied to each of the plurality of short head modules according to locality data for flow path resistance of the common supply flow channel of the base plate.

As described above, according to the liquid droplet ejection head and the image forming apparatus of the present invention, by installing a plurality of short head modules detachably with respect to a common supply flow channel formed throughout the full lengthwise dimension of a base plate, in such a manner that the short head modules are able to receive a supply of liquid from the common supply flow channel, then high-speed ejection can be performed and furthermore, the structure can be simplified, production yield can be improved and maintenance properties can also be improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
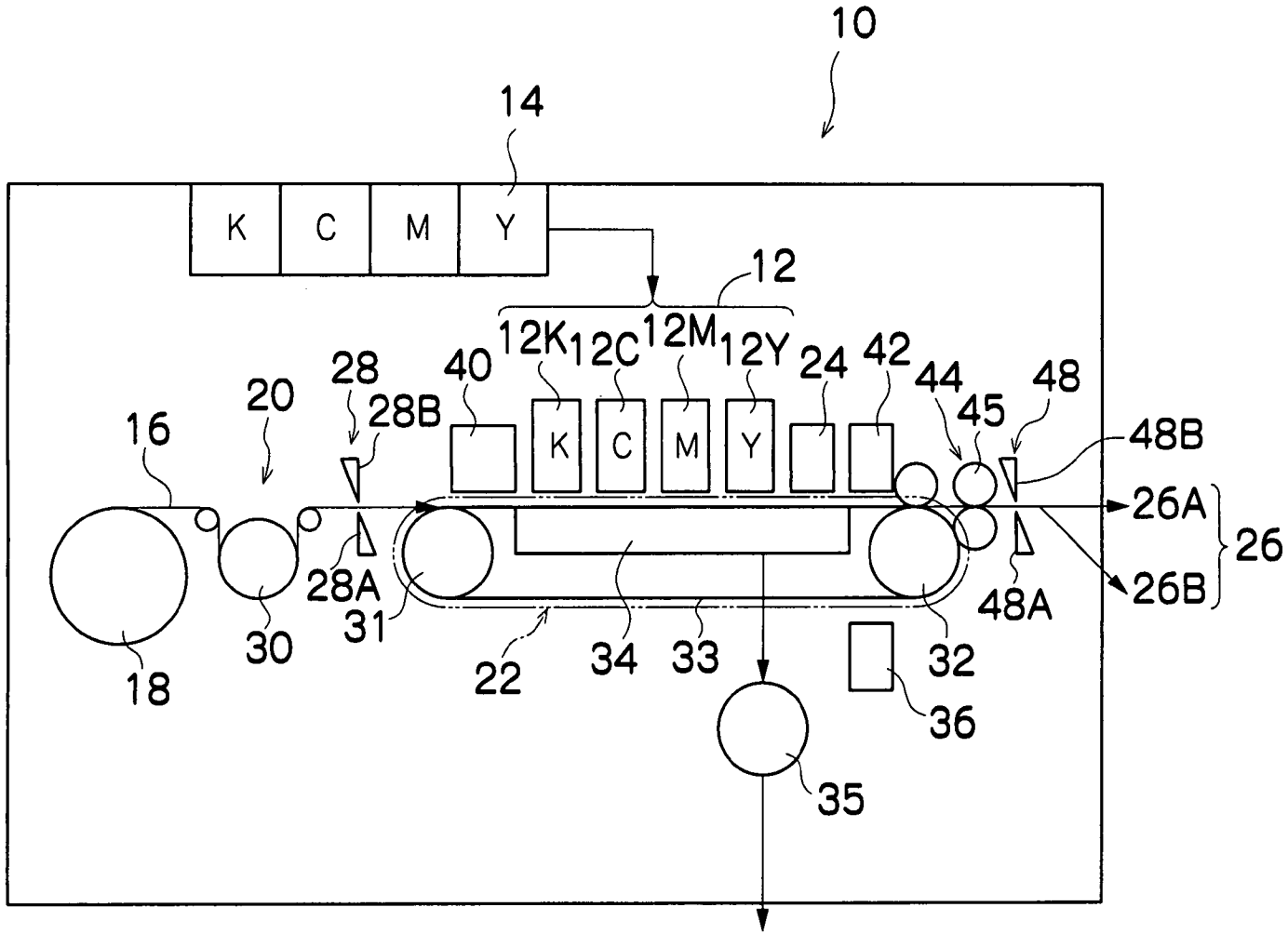
FIG. 1 is a general compositional diagram showing an inkjet recording apparatus forming an image forming apparatus according to an embodiment of the present invention.

FIG. 1 is a general compositional diagram showing an inkjet recording apparatus forming an image forming apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink ejection surface) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink ejection is controlled so that the ink is ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 20 has a curl in which the surface on which the print is to be made is slightly rounded in the outward direction.

In the case of the configuration in which roll paper is used, a cutter (a first cutter) 28 is provided as shown in FIG. 1, and the continuous paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

After decurling in the decurling unit 24, the cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and this suction chamber 34 provides suction with a fan 35 to generate a negative pressure, thereby holding the recording paper 16 onto the belt 33 by suction.

The belt 33 is driven in the clockwise direction in FIG. 1 by the motive force of a motor 88 (not shown in FIG. 1, but shown in FIG. 9) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different than that of the belt 33, in order to improve the cleaning effect.

Instead of the suction belt conveyance unit 22, it is possible to use a roller nip conveyance mechanism. However, when the print region passes through the roller nip mechanism, the printed surface of the paper makes contact with the nip roller immediately after printing, and smearing of the image is thereby liable to occur. It is hence preferable to use the suction belt conveyance mechanism, in which nothing comes into contact with the image surface in the printing area.

A heating fan 40 is provided on the upstream side of the print unit 12 in the paper conveyance path formed by the suction belt conveyance unit 22. This heating fan 40 blows heated air onto the recording paper 16 before printing, and thereby heats up the recording paper 16. Heating the recording paper 16 before printing means that the ink will dry more readily after landing on the paper.

Figure 2:
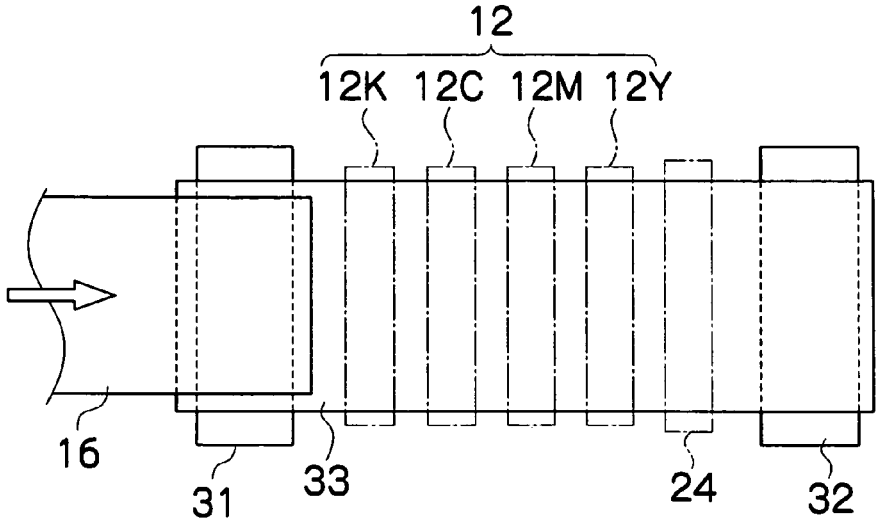
FIG. 2 is a plan view of the peripheral area of a print unit in the inkjet recording apparatus illustrated in FIG. 1.

The print unit 12 is a so-called "full line head", in which a line head having a length corresponding to the maximum paper width is arranged in a direction (main scanning direction) that is perpendicular to the paper feed direction (see FIG. 2). Each of the print heads 12K, 12C, 12M, and 12Y is constituted by a line head, in which a plurality of ink ejection apertures (nozzles) are arranged along a length that exceeds at least one side of the maximum-size recording paper 16 intended for use in the inkjet recording apparatus 10, as shown in FIG. 2. An example of the detailed structure is described below.

The print heads 12K, 12C, 12M and 12Y corresponding to respective ink colors are arranged in the order, black (K), cyan (C), magenta (M) and yellow (Y), from the upstream side, in the feed direction of the recording paper 16 indicated by the arrow in FIG. 2 (namely, the paper conveyance direction, which is also referred to as the "sub-scanning direction" and perpendicular to the above-described main scanning direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (in other words, by means of a single sub-scan). Higher-speed printing is thereby made possible and productivity can be improved in comparison with a shuttle type head configuration in which a recording head moves reciprocally in the main scanning direction, which is perpendicular to the paper conveyance direction or the sub-scanning direction.

In the above descriptions, the conveyance direction of the recording paper 16 is taken to be the sub-scanning direction, and the breadthways direction of the recording paper 16, which is perpendicular to the sub-scanning direction is taken to be the main scanning direction. Here, the concepts of main scanning and sub scanning in the nozzle drive control method, will be described.

In a full-line head having a row of nozzles which corresponds to the full width of the recording medium (recording paper 16), when the nozzles are driven, either (1), all of the nozzles are driven simultaneously, or (2) the nozzles are driven successively from one side towards the other side, or (3) the nozzles are divided up into blocks and are driven successively in each of these blocks, from one side towards the other; and the driving of the nozzles in order to print a single line or a single band in the breadthways direction of the printing paper (the direction perpendicular to the direction of conveyance of the printing paper) is defined as main scanning.

On the other hand, "sub-scanning" is defined as a method of driving the nozzles so as to repeatedly perform printing of one line (a line formed of a row of dots, or a line formed of a plurality of rows of dots) formed by the main scanning described above, while moving the full-line head and the recording medium relatively to each other.

Although the configuration with the KCMY four standard colors is described in the present embodiment, the combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the print heads 12K, 12C, 12M and 12Y, and the tanks are connected to the print heads 12K, 12C, 12M and 12Y through tube channels (not shown). The ink storing and loading unit 14 has a warning device (for example, a display device or an alarm sound generator) for warning when the remaining amount of any ink is low, and also has a mechanism for preventing loading errors among the colors.

The print determination unit 24 has an image sensor for capturing an image of the ink-droplet deposition result of the printing unit 12, and functions as a device to check for ejection defects such as clogs of the nozzles in the printing unit 12 according to the ink-droplet deposition results evaluated by the image sensor.

The print determination unit 24 of the present embodiment is constituted by at least a line sensor having rows of photoelectric transducing elements of a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of the line sensor, it is possible to use an area sensor composed of photoelectric transducing elements which are two-dimensionally arranged.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position. The print determination unit 24 is provided with a light source to illuminate the dots formed on the recording paper 16.

A post-drying unit 42 is disposed following the print determination unit 24. The post-drying unit 42 is a device to dry the printed image surface, and includes a heating fan, for example. It is preferable to avoid contact with the printed surface until the deposited ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed object generated in this manner is outputted via the paper output unit 26. If the main image (a print of the target image) and the test print are formed simultaneously in a parallel fashion, on a large piece of printing paper, then the portion corresponding to the test print is cut off by means of a cutter (second cutter 48). The cutter 48 is disposed immediately in front of the paper output section 26, and it serves to cut and separate the main image from the test print section, in cases where a test image is printed onto the margin of the print. The structure of the cutter 48 is similar to that of the first cutter 28 described previously, and the cutter 48 is constituted by a fixed blade 48A and a circular blade 48B.

Although not shown in FIG. 1, the paper output unit 26 for the target prints is provided with a sorter for collecting prints according to print orders.

Next, the structure of a print head will be described. The print heads 12K, 12C, 12M and 12Y of the respective ink colors have the same structure, and a reference numeral 50 is hereinafter designated to any of the print heads.

Figure 3:
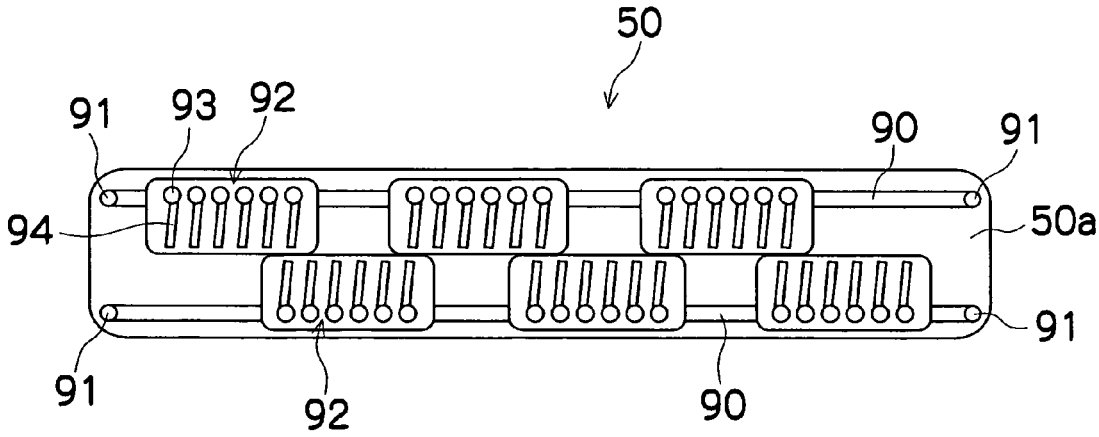
FIG. 3 is a bottom plan view of the print head according to a first embodiment.

FIG. 3 is a bottom plan view of the print head according to the present embodiment. As shown in FIG. 3, the print head 50 is a long line head in which two common liquid chambers 90 are parallelly arranged in upper and lower positions in the drawing along the lengthwise direction of a long and highly rigid base substrate (hereinafter referred to as a base plate)

50*a*, and short head modules (hereinafter referred to as short heads) 92 are arranged in mutually alternating fashion on the respective common liquid chambers 90 (in the example shown in FIG. 3, three short heads 92 are arranged respectively at the upper and lower common liquid chambers 90). The common liquid chambers 90 serve as common supply flow channels for supplying ink to the short heads 92.

The short heads 92 are detachably installed on the base plate 50*a*, and they can be removed straightforwardly, in such a manner that, in the event of a fault, it is only necessary to independently replace the faulty short head 92. Furthermore, the short heads 92 are disposed in such a manner that they overlap mutually to some extent in the lengthwise direction of the base plate 50*a*, thereby compensating for the joint sections between the short heads 92.

The long and highly rigid base plate 50*a* can be a rigid body made by laminating together a plurality of thin plates. Ink supply ports 91 through which ink is supplied from the tank in the ink storing and loading unit 14 are provided at both ends of each of the common liquid chambers 90.

A plurality of branch channels 94 are provided in each of the short heads 92, and an ink supply port 93 through which ink is supplied from the common liquid chamber 90 in the base plate 50*a* is provided at one end of each of the branch channels 94. Here, the "branch channel" is the name given to the liquid (ink) flow channel inside the short head, as opposed to the main channel formed by the common liquid chamber 90 in the nozzle plate 50*a*.

Figure 4:
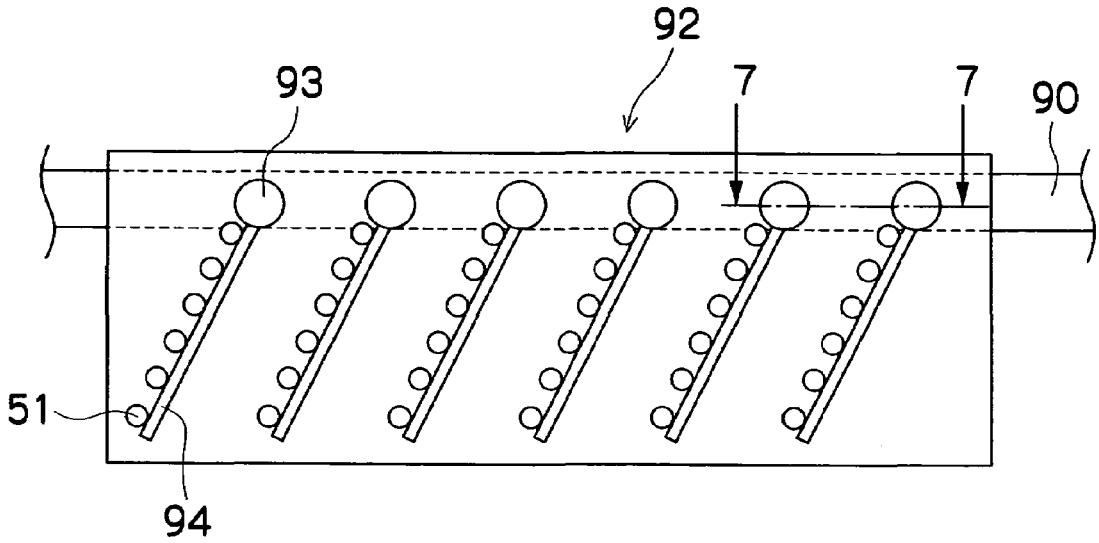
FIG. 4 is an enlarged view of the printing region of a short head according to the first embodiment.

FIG. 4 is an enlarged view of one of the short heads 92. Nozzles 51 for ejecting ink are formed along each of the branch channels 94 of the short head 92. FIG. 4 is a schematic representation, and the number of branch channels 94 and the number of nozzles 51 provided in each branch channel 94 are not limited to those depicted in the drawings. In practice, a larger number of nozzles 51 may be provided in each short head 92. Furthermore, rather than having only one branch channel 94 leading from each ink supply port 93 as shown in FIG. 4, it is also possible for further branch channels (subsidiary branch channels) to fork off from the branch channel 94 that leads from the ink supply port 93.

Figure 5:
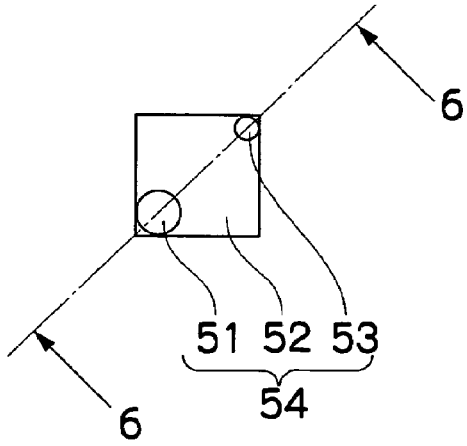
FIG. 5 is a plan view of one of pressure chamber units.

A pressure chamber unit includes a pressure chamber, and the like, which applies a pressure to the nozzle 51 in order to eject ink is provided correspondingly to each of the nozzles 51. FIG. 5 is a plan view of a pressure chamber unit 54 corresponding to one of the nozzles 51.

The pressure chamber unit 54 comprises the pressure chamber 52 connected to the nozzle 51, and an ink supply port (ink supply restrictor) 53 for supplying ink into the pressure chamber 52 from the branch channel 94 (not illustrated in FIG. 5). As shown in FIG. 5, the plan form of the pressure chamber 52 is approximately square shaped, and the nozzle 51 and the ink supply port 53 are formed at respective ends of the diagonal of the plan shape.

Figure 6:
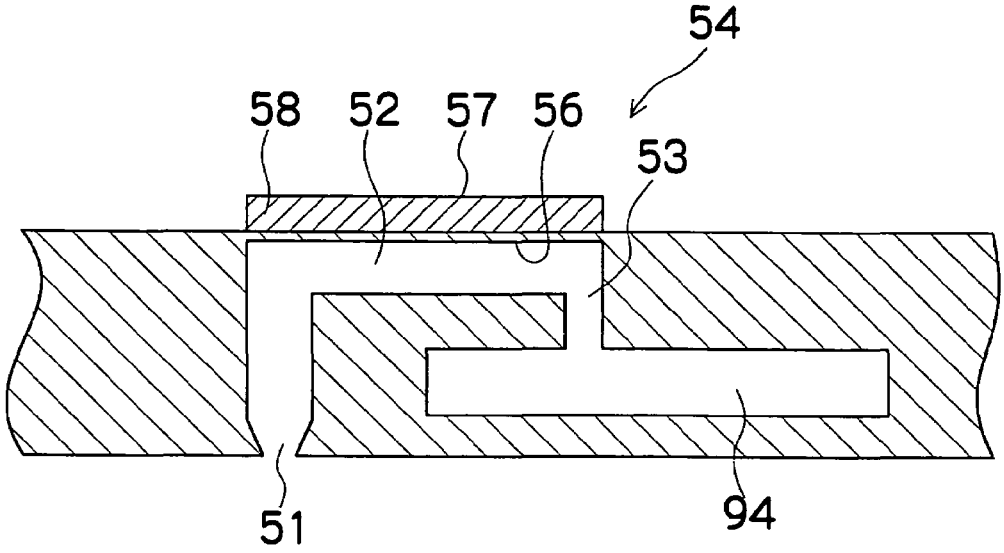
FIG. 6 is a cross-sectional view along line 6-6 in FIG. 5.

FIG. 6 is a cross-sectional view along line 6-6 in FIG. 5. As shown in FIG. 6, an actuator 58 provided with an individual electrode 57 is bonded to a diaphragm 56, which forms the ceiling of the pressure chamber 52. By applying a drive voltage to the individual electrode 57, the actuator 58 is deformed and ink is ejected from the nozzle 51 connected to the pressure chamber 52. The pressure chamber 52 is connected through the ink supply port 53 to the branch channel 94, and when ink has been ejected, new ink is supplied to the pressure chamber 52 from the branch channel 94 through the ink supply port 53.

Figure 7:
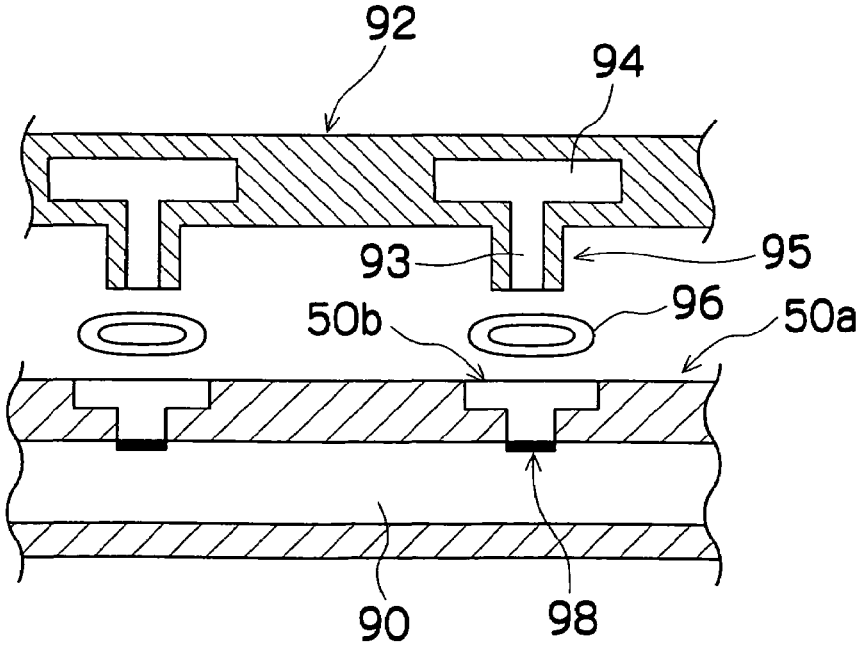
FIG. 7 is a cross-sectional view along line 7-7 in FIG. 4.

FIG. 7 is a cross-sectional view along line 7-7 in FIG. 4. In FIG. 7, the short head 92 and the base plate 50*a* are shown in a separated fashion in order that the method of installing the short head 92 on the base plate 50*a* can be readily understood.

As shown in FIG. 7, in the installation section (coupling section) between the short head 92 and the base plate 50*a*, projecting sections 95 of the short head 92 where the ink supply ports 93 project outward are fixed onto installation holes 50*b* in the base plate 50*a* through O rings 96, thereby ensuring fixing properties and also creating a direct coupling between the branch channels 94 inside the short head 92 and the common liquid chamber 90 formed in the base plate 50*a*.

The short head 92 and the base plate 50*a* are provided with a positioning mechanism to properly position the short head 92 with the base plate 50*a* when the short head 92 is attached on the base plate 50*a*. The positioning mechanism is not limited in particular, and can be achieved by interlocking pins and holes into which these pins are inserted, provided on the respective members, or alternatively, the members can be properly positioned by providing reference holes in the respective members and recognizing images of these holes by means of an automatic device, or the like. Alternatively, the coupling sections constituted by the projecting sections 95 of the short head 92 and the installation holes 50*b* of the base plate 50*a* can be made serve both as a positioning mechanism and the coupling sections for coupling the liquid flow channels. By providing the positioning mechanism in this way, it is possible to readily install and detach the short heads 92. Furthermore, depending on circumstances, it is also possible to completely automate the installation and detachment tasks.

Moreover, a check valve 98 is provided in the installation hole 50*b* of the base plate 50*a* at each coupling section, and hence due to the action of the check valve 98 there is no leakage of ink when the short head 92 is detached from the base plate 50*a*, even if the ink inside the head is not removed previously. In this case, by forming the check valve 98 as a controllable valve and installing another valve that can be opened to the external air in the short head 92, it is possible to remove only the ink inside the short head 92 that is to be detached, before detaching that short head 92 from the base plate 50*a*.

By installing the short heads 92 on the base plate 50*a* in this way, the ink is distributed to the pressure chambers 52 corresponding to the respective nozzles 51 from the common liquid chamber 90 of the base plate 50*a* through the ink supply ports 93, the branch channels 94 inside the short heads 92, and the ink supply ports 53 of the pressure chamber units 54 shown in FIG. 6.

All of the short heads 92 are thus able to receive a supply of ink from the common liquid chamber 90, which is formed in the base plate 50*a* and guarantees a sufficient volume of ink. In this case, in the present embodiment, the short heads 92 are not actually completely independent, and therefore the internal pressure can be controlled throughout the whole heads.

More specifically, in the present embodiment, since it is possible to ensure sufficient ink volume in the two common liquid chambers 90 provided in parallel fashion in the lengthwise direction of the base plate 50*a*, and since all of the short heads 92 are installed in such a manner that they are connected to these common liquid chambers 90 and hence the common liquid chambers 90 are shared by the heads, then the internal pressure can be controlled in a unified fashion. Consequently, it is possible to supply ink efficiently to each of the short heads 92, the internal pressure can be controlled readily, and high-speed ejection of ink becomes possible. Moreover, it is also possible to simplify both the control method and the structure.

Furthermore, the short heads 92 preferably have independent capping mechanisms, in such a manner that they can be cleaned independently. Thereby, it is possible to reduce the amount of ink to be discarded.

Figure 8:
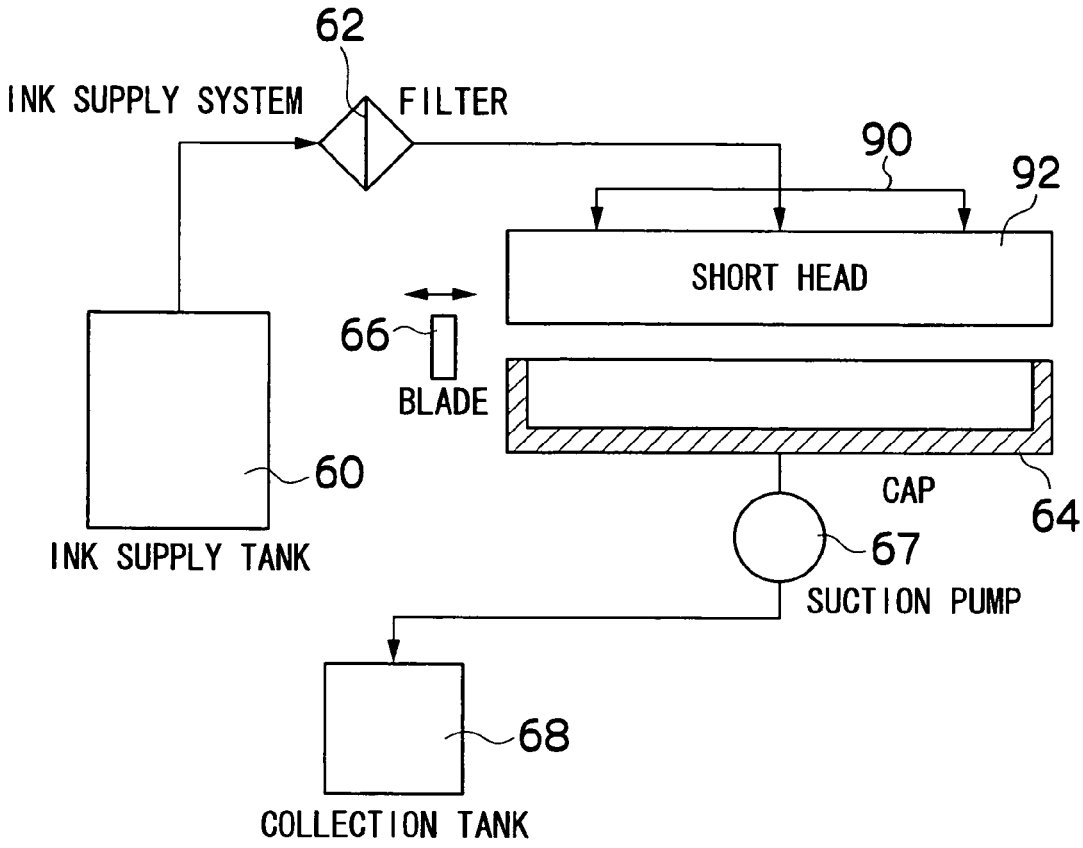
FIG. 8 is a block diagram showing an ink supply system.

FIG. 8 shows the schematic composition of an ink supply system having a separate capping mechanism for each short head 92.

The ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 shown in FIG. 8 is equivalent to the ink storing and loading unit 14 in FIG. 1 described above.

As shown in FIG. 8, ink is supplied from the ink supply tank 60 to the short heads 92 via the common liquid chambers 90 of the base plate 50*a*. A filter 62 for removing foreign matters and bubbles is disposed between the ink supply tank 60 and the short head 92. The filter mesh size in the filter 62 is preferably equivalent to or less than the diameter of the nozzle and commonly about 20 μm.

Although not shown in FIG. 8, it is preferable to provide a sub-tank integrally to the base plate 50*a* or nearby the print head 50. The sub-tank has a damper function for preventing variation in the internal pressure of the head and a function for improving refilling of the print head.

The inkjet recording apparatus 10 is also provided with, for each of the short heads 92, a cap 64 as a device to prevent the nozzles 51 from drying out or to prevent an increase in the ink viscosity in the vicinity of the nozzles 51, and a cleaning blade 66 as a device to clean the face of the nozzles 51.

A maintenance unit including the cap 64 and the cleaning blade 66 can be relatively moved with respect to the short head 92 by a movement mechanism (not shown), and is moved from a predetermined holding position to a maintenance position below the short head 92 as required.

The cap 64 is displaced up and down relatively with respect to the short head 92 by an elevator mechanism (not shown). When the power of the inkjet recording apparatus 10 is switched OFF or when in a print standby state, the cap 64 is raised to a predetermined elevated position so as to come into close contact with the short head 92, and the face of the nozzles 51 (ink ejection surface) is thereby covered with the cap 64.

During printing or standby, if the use frequency of a particular nozzle 51 is low and it continues in a state of not ejecting ink for a prescribed time period or more, then the solvent of the ink in the vicinity of the nozzle evaporates and the viscosity of the ink increases. In a situation of this kind, it will become impossible to eject ink from the nozzle 51, even if the actuator 58 is operated.

Therefore, before a situation of this kind develops (namely, while the ink is within a range of viscosity which allows it to be ejected by operation of the actuator 58), the actuator 58 is operated, and a preliminary ejection (also referred to as "purge", "dummy ejection" or "liquid ejection") is carried out toward the cap 64 (ink receptacle), in order to expel the degraded ink (namely, the ink in the vicinity of the nozzle that has increased viscosity).

Furthermore, if air bubbles enter into the ink inside the short head 92 (inside the pressure chambers 52), then even if the actuator 58 is operated, it will not be possible to eject ink from the nozzles. In a case of this kind, the cap 64 is placed on the short head 92, the ink (ink containing air bubbles) inside the pressure chambers 52 is removed by suction, by means of a suction pump 67, and the ink removed by suction is then sent to a collection tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chambers 52, the ink consumption increases. Therefore, it is preferable to carry out preliminary ejection while the increase in the viscosity of the ink is still minor.

The cleaning blade 66 is composed of rubber or another elastic member, and can slide on the ink ejection surface (surface of the nozzle plate) of the short head 92 by means of a blade movement mechanism (wiper) (not shown). When ink droplets or foreign matter has adhered to the nozzle plate, the surface of the nozzle plate is wiped, and the surface of the nozzle plate is cleaned by sliding the cleaning blade 66 on the nozzle plate. Further, a preliminary ejection is carried out in order to prevent foreign matter from mixing in the nozzles 51 by the blade when the ink ejection surface is cleaned by means of the blade movement mechanism.

Figure 9:
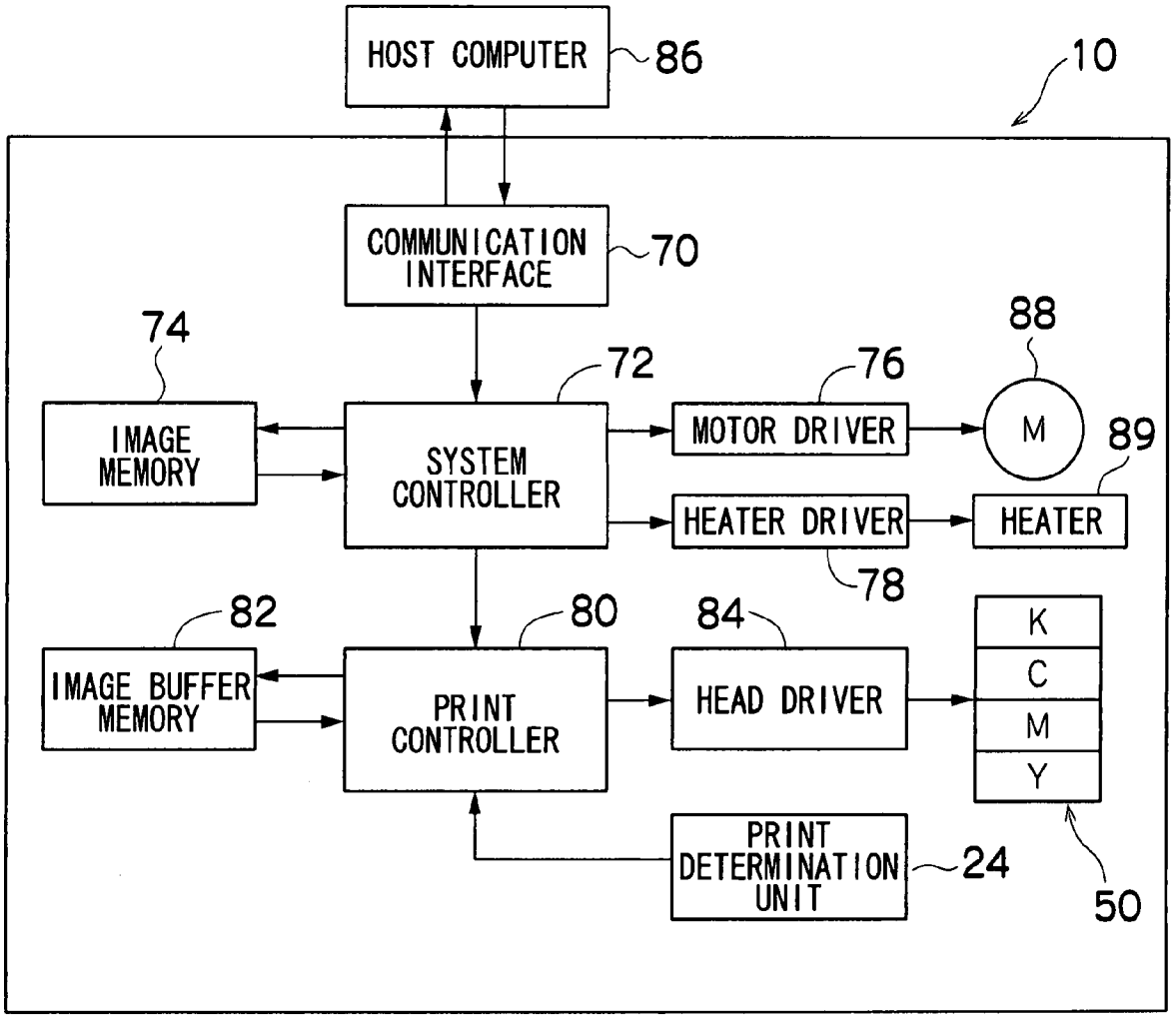
FIG. 9 is a block diagram showing the system composition of the inkjet recording apparatus.

FIG. 9 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 is a control unit for controlling the various sections, such as the communication interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 is a control unit having a signal processing function for performing various treatment processes, corrections, and the like, in accordance with the control implemented by the system controller 72, in order to generate a signal for controlling printing from the image data in the image memory 74. The print controller 80 supplies the print control signal (image data) thus generated to the head driver 84. Prescribed signal processing is carried out in the print controller 80, and the ejection amount and the ejection timing of the ink droplets from each of the short heads 92 of the print head 50 are controlled via the head driver 84, on the basis of the image data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 9 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators of the print head 50 (the print heads of the respective colors, 12K, 12C, 12M, 12Y,) on the basis of print data supplied by the print controller 80. A feedback control system for maintaining constant drive conditions for the print heads may be included in the head driver 84.

In this way, according to the present embodiment, since common supply channels (common liquid chambers 90) are provided in the base plate (base substrate) which is to constitute a long head, and since a long line head (print head 50) is formed by combining this base plate with short heads 92 which are readily attachable and detachable, then it is possible to ensure sufficient ink volume in the common liquid chambers, and the internal pressure can be controlled in the base plate alone, thereby making it possible to simplify the structure.

Furthermore, the attachment and detachment of the short heads with respect to the base plate is simple to perform, and the number of assembly tasks and replacement tasks can be reduced. Therefore, maintenance characteristics can be improved. Moreover, if a fault has occurred in one of the short heads constituting a long line head, then since only the short head suffering the fault needs to be replaced, it is possible to improve the operating rate, production yield and maintenance efficiency.

Next, a second embodiment of the present invention will be described.

The second embodiment is substantially similar to the first embodiment described above, in terms of the overall composition of the image forming apparatus, in which flow channels of sufficient capacity are provided in a long and highly rigid base plate, and a long line head is constituted by detachably combining a plurality of short heads with this base plate.

Figure 10:
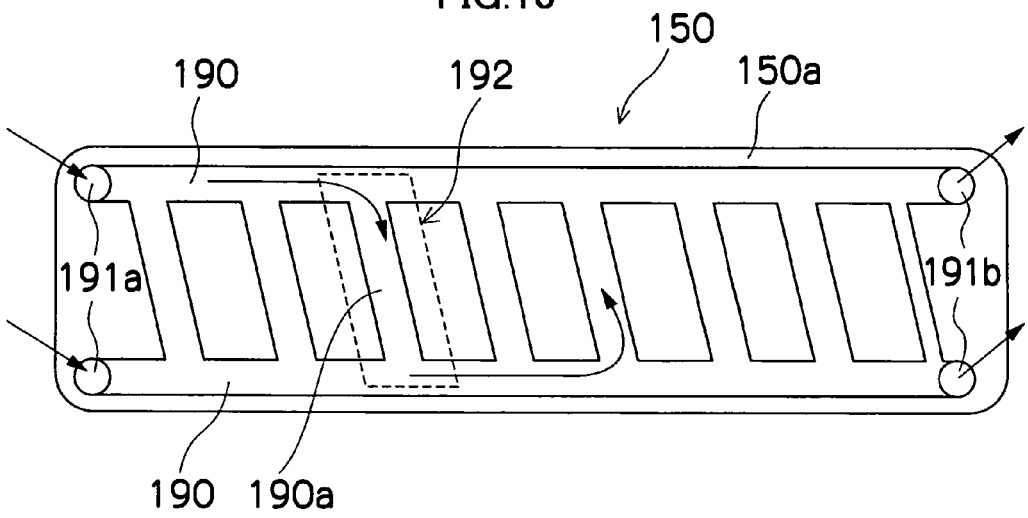
FIG. 10 is a bottom plan view of a print head according to a second embodiment of the present invention.

FIG. 10 is a bottom plan view of a print head according to the second embodiment. In the print head 150 according to the present embodiment, two common liquid chambers 190 are parallelly arranged in upper and lower positions in the drawing along the lengthwise direction of a long and highly rigid base plate 150*a* as shown in FIG. 10. Furthermore, a plurality of common liquid chambers 190*a* having a prescribed inclination with respect to the lengthwise direction are spanned between the two common liquid chambers 190 arranged in parallel with the lengthwise direction, thereby forming a ladder-shaped common liquid chamber.

Ink supply ports 191*a* and 191*b* for receiving supply of ink from ink tanks are provided respectively at either end of both of the two common liquid chambers 190 arranged in parallel with the lengthwise direction. As shown by the arrows in FIG. 10, ink is introduced from one ink supply port 191*a* into each of the common liquid chambers 190 arranged in parallel with the lengthwise direction, the ink is circulated through the two common liquid chambers 190 parallel to the lengthwise direction and the common liquid chambers 190*a* which span between these, and the ink exits from the other ink supply port 191*b* provided in each of the common liquid chambers 190 arranged in parallel with the lengthwise direction. Consequently, a unidirectional ink flow is created without there being any "dead ends" in any part of the common liquid chambers (namely, the common liquid chambers 190 parallel to the lengthwise direction and the common liquid chambers 190*a* spanning between these), and hence ink is circulated throughout the whole of the head.

Furthermore, as indicated in one instance by the broken line in FIG. 10, short heads 192 are installed individually with respect to the common liquid chambers 190*a* which connect the two common liquid chambers 190 arranged in upper and lower positions in parallel with the lengthwise direction. In this way, ink is supplied to the branch channels of the short heads 192.

Figure 11:
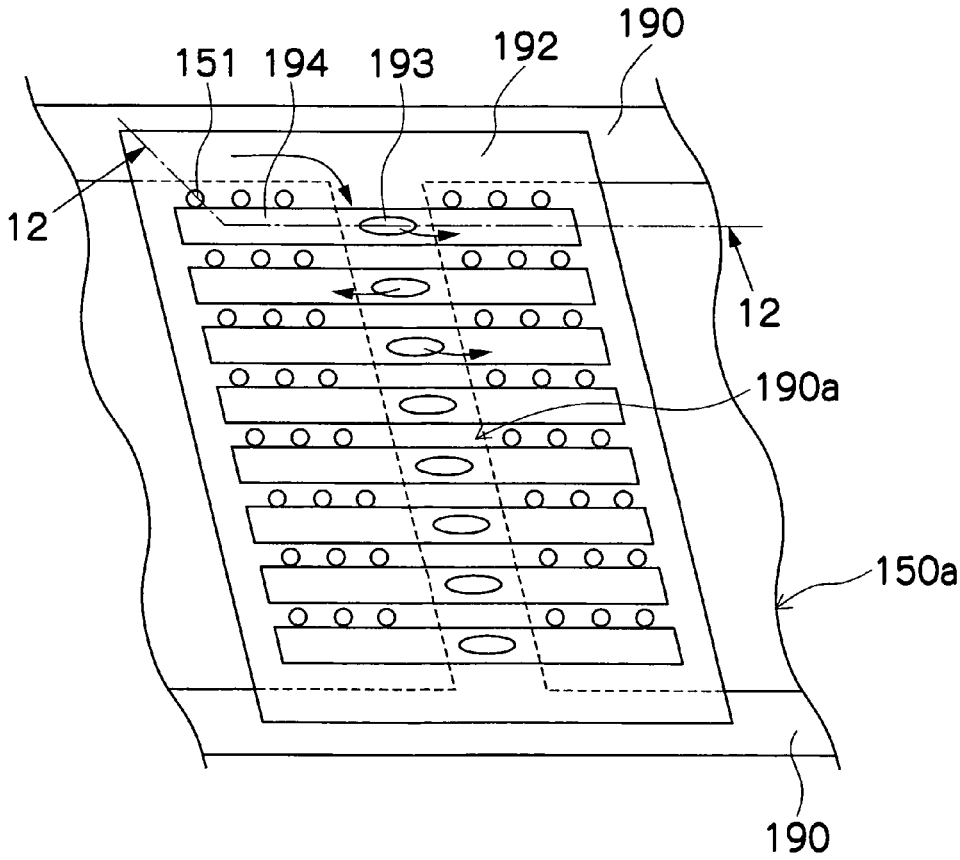
FIG. 11 is a plan view of a short head according to the second embodiment.

FIG. 11 shows a short head 192 disposed on a common liquid chamber 190*a* which spans between the two common liquid chambers 190 arranged in upper and lower positions in parallel with the lengthwise direction, according to the present embodiment.

As shown in FIG. 11, in the short head 192, a plurality of branch channels 194 are formed respectively in parallel, each having a prescribed angle with respect to the lengthwise direction of the base plate 150*a* (see FIG. 10). An ink supply port 193 is provided in the central region of each of the branch channels 194. The ink supply ports 193 are disposed so as to be aligned approximately in one line over the common liquid chamber 190*a* which links the two common liquid chambers 190, 190 that are parallel to the lengthwise direction. Each of the branch channels 194 is connected to a similar number of nozzles 151, in a symmetrical fashion on the left and right-hand sides of the ink supply port 193.

Figure 12:
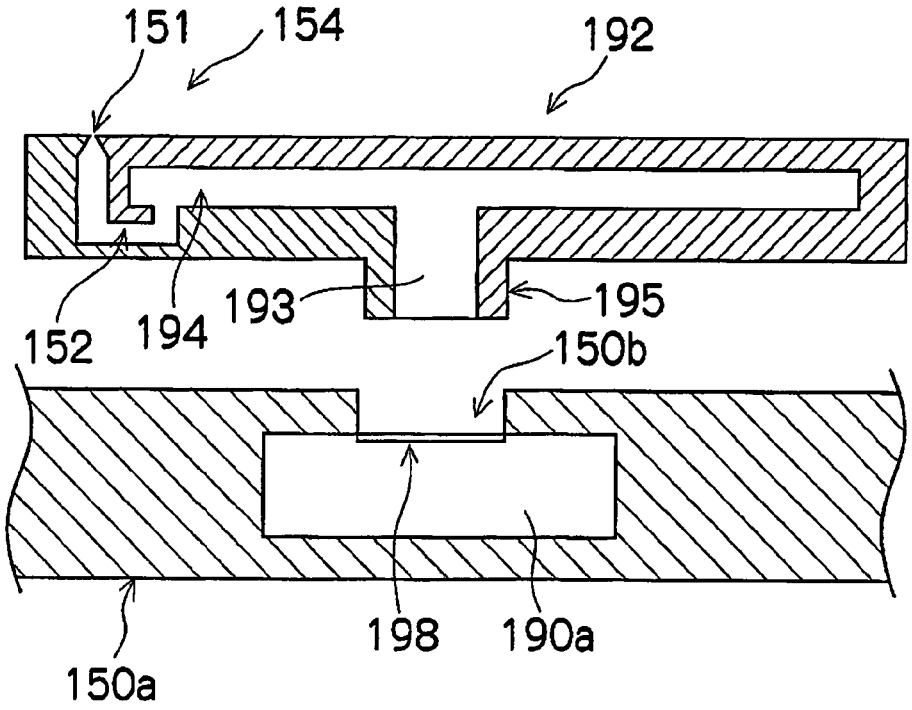
FIG. 12 is a cross-sectional view along line 12-12 in FIG. 11.

FIG. 12 is a cross-sectional view along line 12-12 in FIG. 11.

As shown in FIG. 12, ink supply ports 193 are provided in the short head 192 in approximately the central region of the lengthwise direction of the base plate 150*a* (see FIG. 10), and branch channels 194 are formed extending in a symmetrical fashion to the left and right of the ink supply ports 193. Pressure chamber units 154 corresponding to each nozzle 151 are provided in each of the branch channels 194.

Furthermore, in the installation section (coupling section) between the short head 192 and the base plate 150*a*, an installation hole 150*b* comprising a check valve 198 is formed in the base plate 150*a*, over the common liquid chamber 190*a*, in a position corresponding to a projecting section 195 which projects from the ink supply port 193.

In this way, in the present embodiment, common liquid chambers are formed as a lattice-shaped flow channel structure without any dead-ends, in which two common liquid chambers 190 arranged in parallel with the lengthwise direction of the base plate 150*a* are linked together by common liquid chambers 190*a* oblique to the lengthwise direction, in such a manner that ink can circulate between the chambers. Furthermore, the short heads 192 are installed respectively, one by one, on the respective common liquid chambers 190*a* linking the upper and lower common liquid chambers 190, and a plurality of connecting sections corresponding to the ink supply ports 193 supplying ink to the branch channels 194 of the short heads 192 are provided over each of the common liquid chambers 190*a*, thereby enabling ink to be supplied and circulated via the plurality of ports. In this way, the ink can be made to flow more readily to the nozzles 151 formed in the branch channels 194 of the short heads 192, and the volume of ink that is discarded can be reduced to a minimum. Furthermore, since no dead-end sections are formed in the flow path in the base plate, air bubbles are not liable to collect in the common liquid chambers.

More specifically, in the present embodiment, since all of the common liquid chambers (190, 190*a*) form a unidirectional flow without any dead-ends, then ink replenishment to the common liquid chambers is performed efficiently. Furthermore, it is possible to reduce the amount of ink discarded when caps are applied and suctioning is performed after completing replenishment of ink to all of the common liquid chambers.

Furthermore, in the example shown in the drawings, ink is supplied from two ink supply ports 191*a* on the left-hand side, and ink is expelled from two ink supply ports 191*b* on the right-hand side, but the ink supply method is not limited to this. For example, it is also possible to stabilize the printing operation by supplying ink from the ink supply ports 191*a* and 191*b* provided at the four corners on both the left and right-hand sides. Furthermore, it is also possible to control the flow of ink inside the print head 150 by providing a device for opening and closing the flow of ink, in a flow path (not shown) that is connected to the ink supply ports 191*a* and 191*b*. For example, of the four ink supply ports 191*a* and 191*b* in the respective corner positions, one set of two ports which are located at mutually opposite corners in one diagonal direction can be closed, thereby causing ink to flow in the other diagonal direction only. Consequently, ink can be supplied satisfactorily to all of the common liquid chambers 190 and 190*a*.

In this way, in the present embodiment, ink is taken into the branch channels 194 from the common liquid chambers 190*a*, via the ink supply ports 193 of the short heads 192, and the ink is supplied from the branch channels 194 to the pressure chambers 152 which correspond to the respective nozzles 151. However, it is also possible to supply ink directly to the pressure chambers 152 from the common liquid chambers 190*a* in the base plate 150*a*, without passing through the branch channels 194 in this manner.

Figure 13:
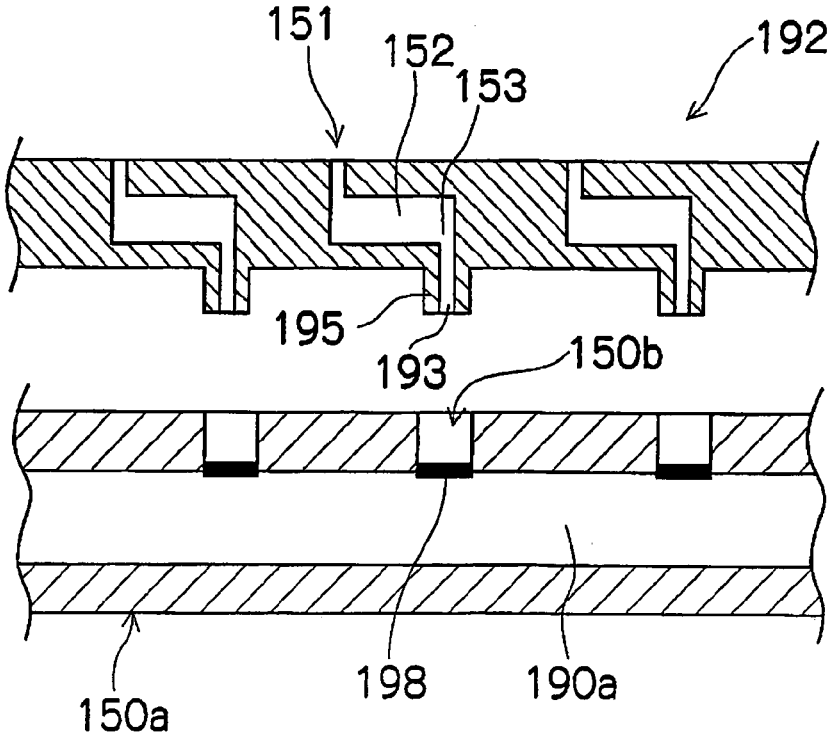
FIG. 13 is a plan view of a further example of the second embodiment.

FIG. 13 shows an example in which ink is supplied directly to the pressure chambers from the common liquid chambers.

As shown in FIG. 13, a pipe (projecting section) 195 of approximately 30 μm internal diameter, for example, projects from the ink supply port 153 of each of the pressure chambers 152 corresponding to the nozzles 151 provided in the short head 192, and the front end of this pipe 195 forms an ink supply port 193, which introduces ink from the common liquid chamber 190*a* of the base plate 150*a*.

On the other hand, in the base plate 150*a*, installation holes 150*b* are provided corresponding to the projecting sections 195, which are provided at the nozzles 151. A check valve 198 is positioned at each of the installation holes 150*b*. The projecting section 195 extending from each pressure chamber 152 in the short head 192 is inserted into the installation hole 150*b* in the base plate 150*a* and pressure-fixed into same, thereby allowing ink to be supplied directly from the common liquid chamber 190*a* to the pressure chamber 152. In this case, the common liquid chambers 190*a* are formed so as to correspond to the positions of the nozzle 151 formed in the short head 192.

The projecting sections 195 having an internal diameter of approximately 30 μm serve as supply restrictors, in such a manner that even if the short head 192 is removed from the base plate 150*a*, ink will not leak out from the ink supply ports 193. Consequently, the structure of the short head 192 is simplified and the short head 192 can be replaced without having to remove the ink inside the short head 192 before it is detached.

Next, a third embodiment of the present invention will be described.

The third embodiment is substantially similar to the first or second embodiment described above, in terms of the overall composition of the image forming apparatus, in which flow channels of sufficient capacity are provided in a long and highly rigid base plate, and a long line head is constituted by detachably combining a plurality of short heads with this base plate.

Figure 14:
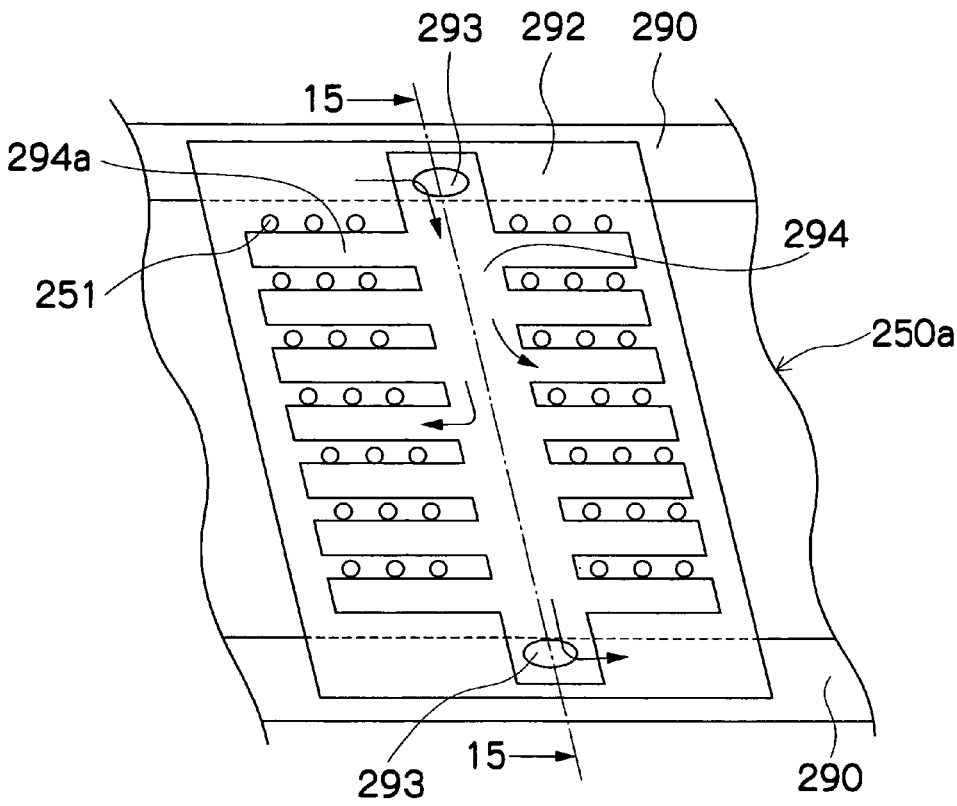
FIG. 14 is a plan view of a short head according to a third embodiment of the present invention.

FIG. 14 shows a short head according to the third embodiment. As shown in FIG. 14, the short head 292 according to the present embodiment is installed in such a manner that it spans between two common liquid chambers 290 provided in parallel alignment with the lengthwise direction of a base plate 250*a*.

One branch channel 294 is formed in the central region of the short head 292 in such a manner that it spans between the two common liquid chambers 290, and ink supply ports 293 for introducing ink respectively from the common liquid chambers 290 are provided at either end of the branch channel 294.

A plurality of subsidiary branch channels 294*a* are formed extending respectively in parallel from the branch channel 294, and each of these subsidiary branch channels 294*a* is connected respectively to a plurality of nozzles 251.

Figure 15:
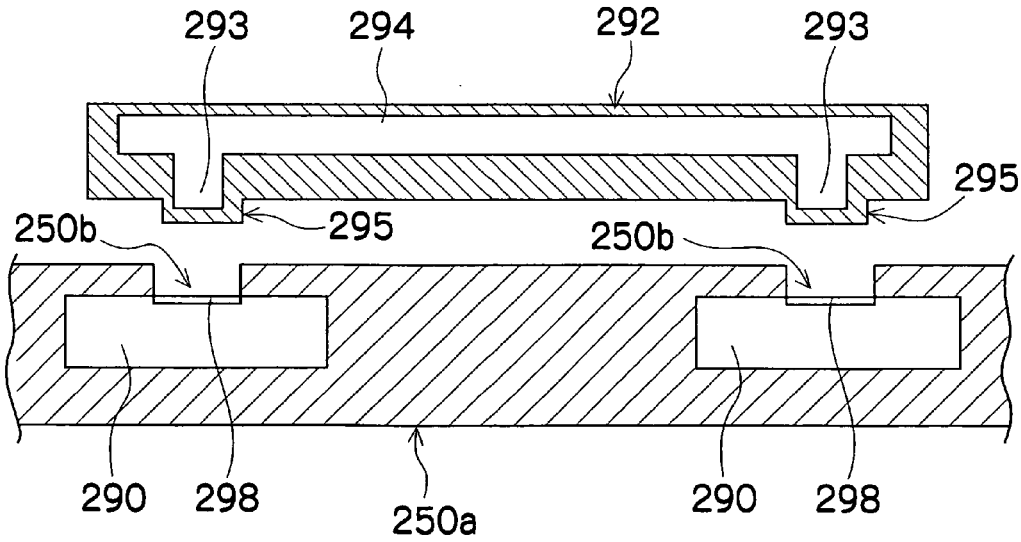
FIG. 15 is a cross-sectional view along line 15-15 in FIG. 14.

FIG. 15 is a cross-sectional view along line 15-15 in FIG. 14.

The branch channel 294 in the short head 292 is formed by piercing through the interior of the short head 292 from one end to the other, and projecting sections 295 comprising the ink supply ports 293 are formed at both ends of the branch channel 294 in order to connect with the base plate 250*a*.

Installation holes 250*b* for receiving the projecting sections 295 are provided on the common liquid chamber 290 side of the base plate 250*a*. A check valve 298 is positioned at each installation hole 250*b*.

By inserting the projecting sections 295 at either end of the branch channel 294 of the short head 292 into the installation holes 250*b* in the base plate 250*a*, the two common liquid chambers 290 become connected together by means of the branch channel 294 of the short head 292.

Consequently, as indicated by the arrows in FIG. 14, ink is supplied to the branch channel 294 from one of the common liquid chambers 290, via one of the ink supply ports 293 of the branch channel 294, and this ink is supplied to the respective nozzles 251 via the subsidiary branch channels 294*a*. Furthermore, ink successively exits from the other ink supply port 293 of the branch channel 294 and into the other common liquid chamber 290, in such a manner that the ink is circulated within the short head 292.

In the second embodiment described above, there are a plurality of ink supply ports 193 which form connecting sections between the common liquid chambers 190*a* and the branch channels 194 of the short head 192 as shown in FIG. 11. On the other hand, in the third embodiment, only two ink supply ports 293 forming connecting sections between the branch channel 294 of the short head 292 and the common liquid chambers 290 are provided as shown in FIG. 14, in upper and lower positions in the diagram.

In this way, by reducing the number of connecting sections (coupling sections) in such a manner that ink introduced from one ink supply port 293 is supplied to all of the pressure chambers 252, it is possible to suppress variations in ink ejection caused by variations in the sealing properties of the connecting sections in the short head 292.

Next, a fourth embodiment of the present invention will be described.

Figure 16:
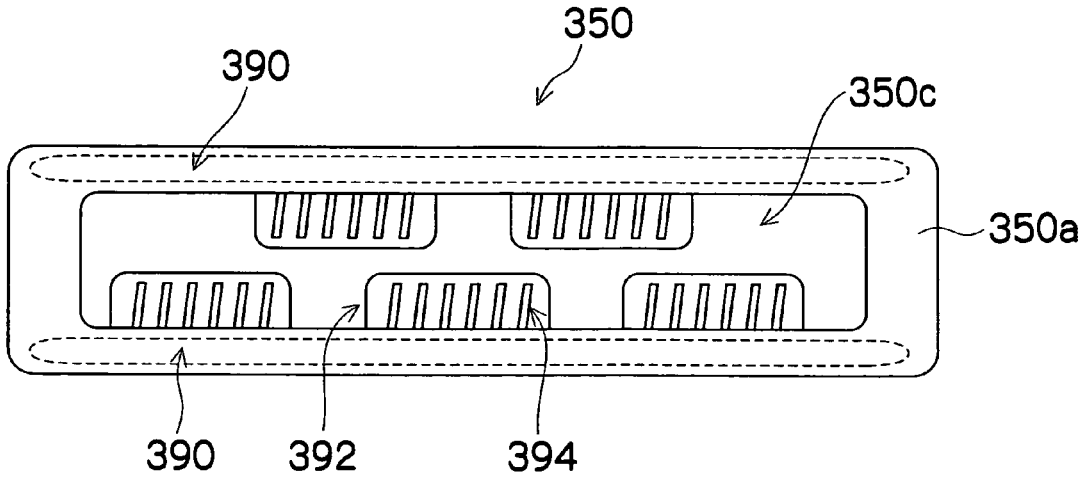
FIG. 16 is a plan view of a print head according to a fourth embodiment of the present invention.

FIG. 16 is a plan view of the print head according to the fourth embodiment. As shown in FIG. 16, in the print head 350 according to the present embodiment, the central portion of a long and highly rigid base plate 350*a* is cut away to form an open space 350*c*. More specifically, the base plate 350*a* simply forms a rectangular frame which is elongated in the lateral direction.

Common liquid chambers 390 are formed in the lengthwise portions of the frame-shaped base plate 350*a*. Although omitted in FIG. 16, ink supply ports for receiving a supply of ink from the ink tank are provided at either end of each of the common liquid chambers 390.

Furthermore, FIG. 16 is a diagram viewed from above, and a plurality of short heads 392 are arranged in mutually alternating fashion in the lengthwise direction on the lower side of the frame-shaped base plate 350*a*, and are installed thereon detachably. Similarly to the first embodiment, a plurality of branch channels 394 are provided in each short head 392. Although not shown in FIG. 16, a plurality of nozzles are provided along the branch channels 394, and an ink supply port for introducing ink from a common liquid chamber 390 is provided at one end of each branch channel 394.

In the present embodiment, since the central portion of the base plate 350*a* is open, then access is provided for wiring to the actuators, and the like, which form a drive source for the short heads 392.

Next, a fifth embodiment of the present invention will be described.

If a long line head is composed by combining a plurality of short heads with common liquid chambers formed in a long base plate, then since there is locality due to the flow resistance of the common liquid chamber, in other words, variation in the flow path resistance, or the like, in accordance with the position in the common liquid chamber from the ink supply port connected to the ink tank, there is a risk that variation in the ink ejection volume may arise in accordance with the position of installation of the respective short heads. Therefore, in such cases, drive waveforms which seek to correct this variation in the ejection amount are supplied to the respective pressure chamber units.

Figure 17:
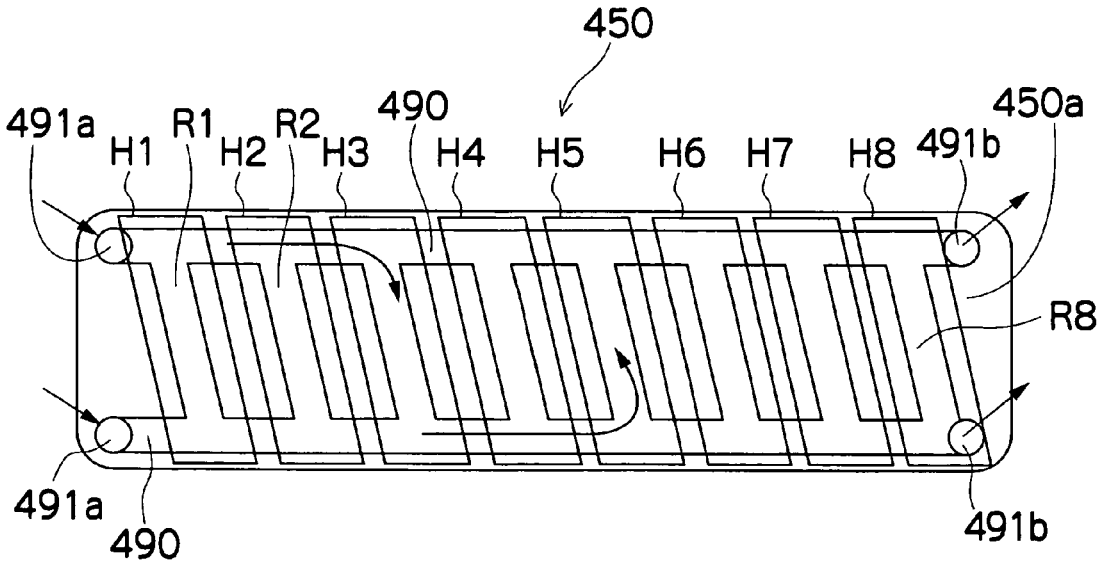
FIG. 17 is a plan view of a print head according to a fifth embodiment of the present invention.

FIG. 17 shows a print head according to the fifth embodiment. As shown in FIG. 17, similarly to the print head 150 of the second embodiment illustrated in FIG. 10, two common liquid chambers 490 are formed in parallel with the lengthwise direction of the print head 450 according to the present embodiment, and a plurality of common liquid chambers R1-R8 are formed so as to span between these two common liquid chambers 490, thereby creating a lattice of common liquid chambers (490, R1, . . . , R8). Short heads H1-H8 are installed respectively, in a detachable fashion, on the common liquid chambers R1-R8. Although not shown in FIG. 17, branch channels and nozzles are formed in the short heads H1-H8.

Ink supply ports 491*a* and 491*b* which respectively receive a supply of ink from the ink tanks are provided at either end of the two common liquid chambers 490, which are arranged in parallel with the lengthwise direction. As shown by the arrows in FIG. 17, ink is supplied from one ink supply port 491*a* to each common liquid chamber 490, the ink flows from left to right through the common liquid chambers 490, the ink circulates through the common liquid chambers 490, and the like, and exits from the other ink supply ports 491*b*.

The flow rate characteristics f(R1), f(R2), . . . of the respective common liquid chambers R1, R2, . . . are determined by the intrinsic structure of the base plate 450*a*. Therefore, using a function g, correctional coefficients $\alpha 1$, $\alpha 2$, . . . , are established for the amplitude of the respective drive waveforms for the short head H1 connected to the common liquid chamber R1, the short head H2 connected to the common liquid chamber R2, and so on.

In other words, the correctional coefficients are set to $\alpha 1 = g(f(R1))$, $\alpha 2 = g(f(R2))$, and so on. This correctional coefficient $\alpha$ follows the graph shown in FIG. 18 in the case of a base plate having a structure in which the supply resistance on the right-hand side of the diagram is greater than the supply resistance on the left-hand side, as illustrated in FIG. 17, for example. Consequently, by forming the short heads 492 into a common module, and controlling the print head 450 by means of the head driver 84, which controls the ejection drive waveform via the aforementioned print controller 80 (see FIG. 9), in accordance with the installation position of each short head in the base plate 450*a*, then it is possible to obtain a prescribed uniform ejection amount through correcting the ink ejection.

Furthermore, in addition to this, in order to reduce variation in the ejection amount due to locality of the flow path resistance of the common liquid chamber in the base plate, it is also possible to further increase the capacity of the common liquid chambers so that the common liquid chambers also serve as ink tanks.

Figure 18:
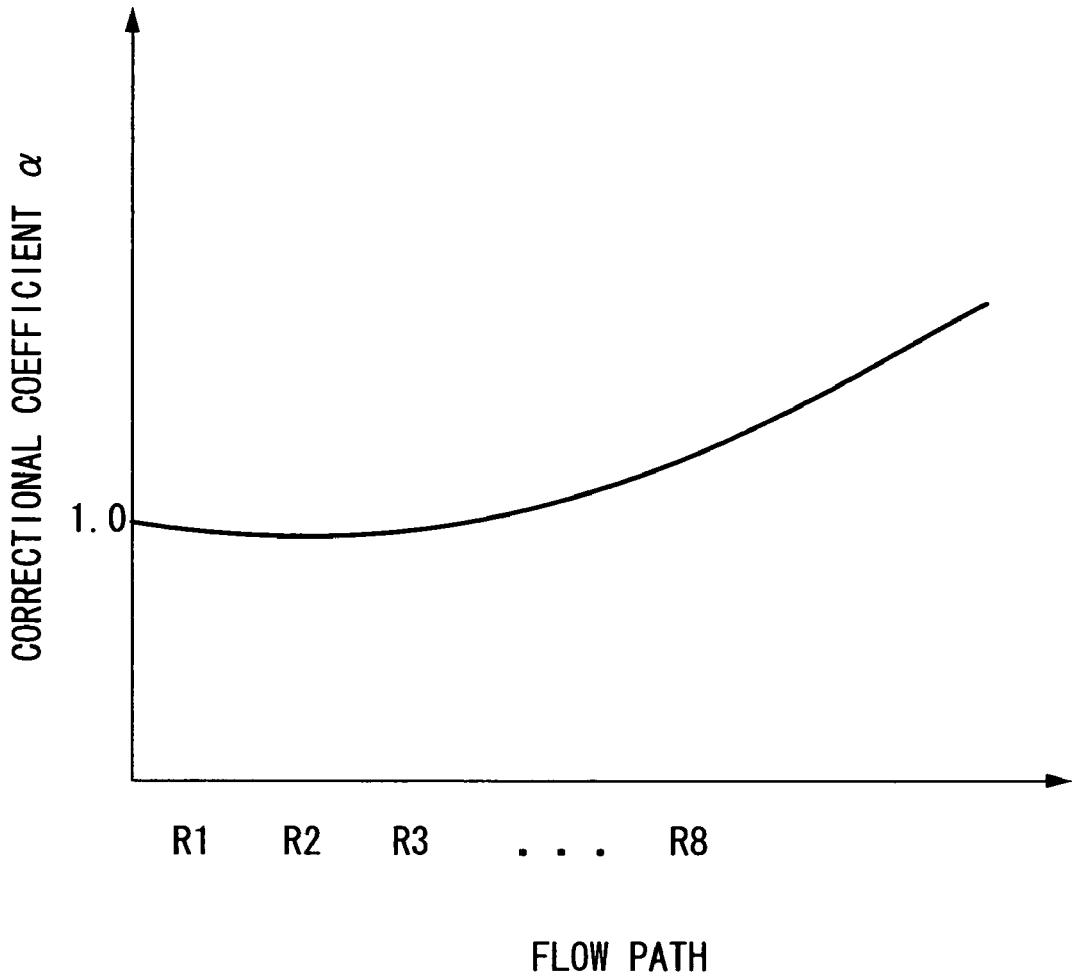
FIG. 18 is a graph showing a correctional coefficient for correcting the locality of the discharge amount.

When the method for supplying ink to the common liquid chambers 490 of the base plate 450*a* is different from that above described, the locality caused by the flow resistance of the common liquid chambers of the base plate varies dependently on the method for supplying ink, and correctional coefficients different from that illustrated in FIG. 18 are established for the common liquid chambers R1-R8.

The branch channels of the short heads are all connected respectively to the common liquid chambers of a base plate in the above-described embodiments, but it is also possible to connect the flow channels of the short heads together and to connect the flow channels of only a portion of the short heads to the common liquid chambers (main channels) in the base plate.

Moreover, the O rings are used in the connection between the short heads and the base plate in the above-described embodiments, but it is also possible to fix the members and ensure sealing by providing a rubber layer having good hermetic sealing properties between the short heads and the base plate instead of using O rings.

Furthermore, the positioning pins used when attaching the short heads to the base plate may be formed commonly with the ink supply ports of the short heads. Alternatively, it is possible to carry out the positioning of the members by means of the electrical wiring terminals which connect to the short head.

The present invention has been described above with respect to various embodiments, and in all cases, common liquid chambers are provided in a long and highly rigid base plate and a long line head is formed by combining short heads with this base plate, in such a manner that the short heads are easily registered in position when installed on the base plate, the short heads being installed detachably, thereby allowing them to be replaced on an individual basis.

By this means, it is possible to ensure sufficient volume of ink in the common liquid chambers, and since the common liquid chambers are shared by all of the short heads, the internal pressure can be controlled in a unified manner. Furthermore, high-speed ejection becomes possible and the control method and structure of the head can be simplified.

Moreover, the number of work tasks involved in assembling the print head and in replacing the short heads can be reduced, and therefore, assembly characteristics and maintenance characteristics can be improved.

Furthermore, even if a fault occurs in one of the short heads, since it is possible to replace the faulty short head alone, the operating rate and production yield rate can be improved.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet ejection head, comprising:

a base plate which has a common supply flow channel formed throughout an entire dimension in a lengthwise direction of the base plate;

a plurality of short head modules which are assembled on the base plate to form a long head, each of the plurality of short head modules including ejection ports ejecting droplets of liquid and a liquid flow channel supplying the liquid to the ejection ports from the common supply flow channel;

a positioning mechanism through which the short head modules are detachably installed on the base plate; and a check valve provided on the base plate at a connecting section between the common supply flow channel of the base plate and the liquid flow channel in each of the plurality of short head modules, wherein when replacing one of the plurality of short head modules, the one of the plurality of short head modules is removed after the liquid is emptied out of the one of the plurality of short head modules through the check valve.

2. An image forming apparatus comprising:

a liquid droplet ejection head, including:

a base plate having two common supply flow channels positioned parallel to each other throughout an entire dimension in a lengthwise direction of the base plate, one common supply flow channel being positioned proximate a first lengthwise direction edge of the base plate and the other common supply flow channel being positioned proximate a second lengthwise direction edge of the base plate, parallel to the first lengthwise direction edge;

a plurality of short head modules which are assembled on the base plate to form a long head, each of the plurality of short head modules receiving liquid from one or the other of the two common supply flow channels, but not both, and including a plurality of liquid flow channels, each liquid flow channel being connected to a plurality of ejection ports with all ejection ports of said each short head module ejecting droplets of the liquid supplied from said one or the other of the two common supply flow channels; and a positioning mechanism through which the short head modules are detachably installed on the base plate, wherein a drive waveform which corrects an ejection amount of each of the plurality of short head modules is applied to each of the plurality of short head modules according to locality data for flow path resistance of the two common supply flow channels of the base plate.

3. An image forming apparatus including a liquid droplet ejection head comprising:

a base plate which has a common supply flow channel formed throughout an entire dimension in a lengthwise direction of the base plate;

a plurality of short head modules which are assembled on the base plate to form a long head, each of the plurality of short head modifies including ejection ports ejecting droplets of liquid and a liquid flow channel supplying the liquid to the ejection ports from the common supply flow channel; and a positioning mechanism through which the short head modules are detachably installed on the base plate, wherein a drive waveform which corrects an ejection amount of each of the plurality of short head modules is applied to each of the plurality of short head modifies according to locality data for flow path resistance of the common supply flow channel of the base plate.

* * * * *